US009476640B2

(12) United States Patent
Le Bot

(10) Patent No.: US 9,476,640 B2
(45) Date of Patent: Oct. 25, 2016

(54) METHOD AND APPARATUS FOR PRODUCING NITROGEN BY CRYOGENIC DISTILLATION OF AIR

(75) Inventor: Patrick Le Bot, Vincennes (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 796 days.

(21) Appl. No.: 13/087,702

(22) Filed: Apr. 15, 2011

(65) Prior Publication Data

US 2011/0259047 A1 Oct. 27, 2011

(30) Foreign Application Priority Data

Apr. 22, 2010 (FR) ..... 10 53075

(51) Int. Cl.
*F25J 3/04* (2006.01)
*F25J 3/06* (2006.01)

(52) U.S. Cl.
CPC ..... *F25J 3/044* (2013.01); *F25J 3/04254* (2013.01); *F25J 3/04793* (2013.01); *F25J 3/0655* (2013.01); *F25J 2210/42* (2013.01); *F25J 2215/44* (2013.01); *F25J 2220/44* (2013.01)

(58) Field of Classification Search
CPC ..... F25J 1/0261; F25J 1/0665; F25J 3/0261; F25J 3/04478; F25J 3/04484; F25J 3/0449; F25J 2215/14; F25J 3/044; F25J 2215/44
USPC ..... 62/643, 646, 656, 654
See application file for complete search history.

(56) References Cited

U.S. PATENT DOCUMENTS 3,619,377 A * 11/1971 Palmer ..... B01D 3/425 196/141
4,617,040 A * 10/1986 Yoshino ..... F25J 3/042 62/656
4,784,677 A * 11/1988 Al-Chalabi ..... 62/656
5,351,492 A * 10/1994 Agrawal ..... F25J 3/04048 62/648
5,441,719 A * 8/1995 Nagamura ..... C01B 21/0416 422/609

(Continued)

FOREIGN PATENT DOCUMENTS

EP 0376465 7/1990
EP 0589646 3/1994

(Continued)

OTHER PUBLICATIONS

Search Report for FR 1053075.

*Primary Examiner* — Frantz Jules
*Assistant Examiner* — Brian King
(74) *Attorney, Agent, or Firm* — Justin K. Murray

(57) ABSTRACT

In a method for producing nitrogen by cryogenic distillation, air containing carbon monoxide is sent to a cryogenic distillation column (5), a flow D of nitrogen is taken from the top of the distillation column, with a CO content less than a fixed value S1, and a flow of nitrogen-rich cryogenic liquid coming from an external source (7) is sent to the top of the column, the flow rate of cryogenic liquid sent to the column being less than a value V if the CO content in the air does not exceed a previously defined threshold (S0), and the flow rate of cryogenic liquid sent to the column being greater than a value V if the carbon monoxide content of the air exceeds this previously defined threshold (S0).

21 Claims, 1 Drawing Sheet

(56) References Cited

U.S. PATENT DOCUMENTS 5,511,380 A * 4/1996 Ha ..... 62/646
5,589,151 A * 12/1996 Gary ..... 423/351
6,006,546 A * 12/1999 Espie ..... F25J 3/04412 62/656
2009/0314031 A1* 12/2009 Davidian ..... F25J 3/04254 62/644

FOREIGN PATENT DOCUMENTS

| | | |
|---|---|---|
| EP | 0595672 | 5/1994 |
| JP | 1269892 | 10/1989 |
| JP | 5001882 | 1/1993 |

* cited by examiner

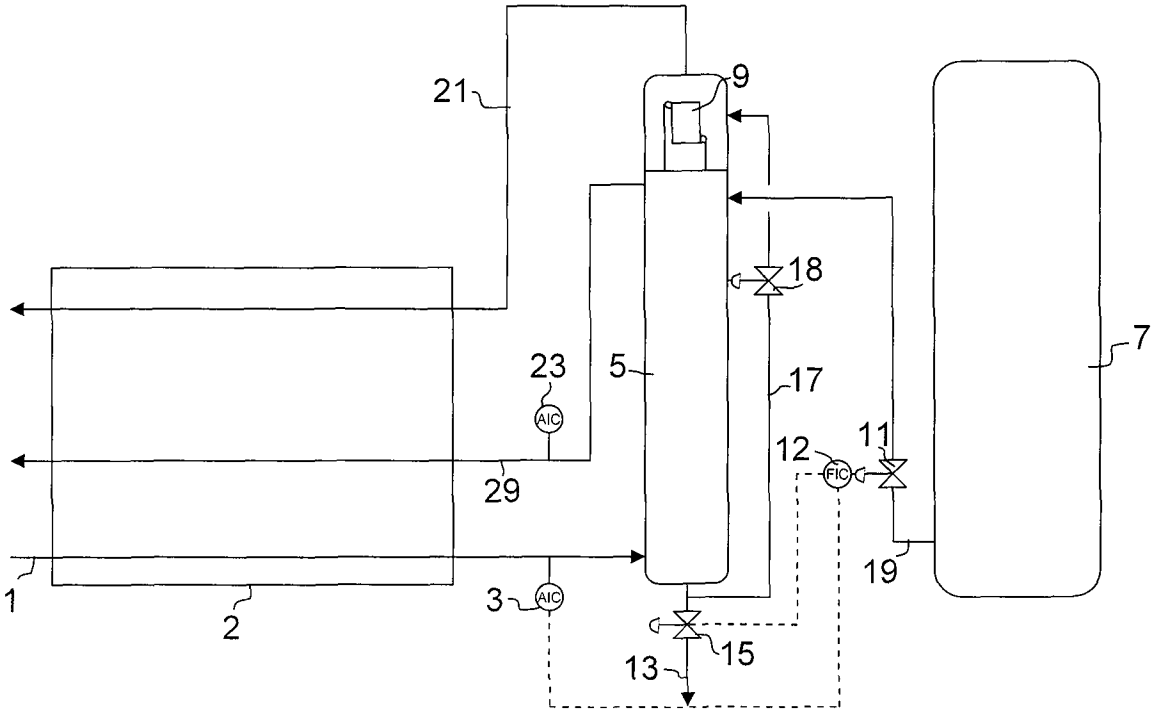
7
11
19
FIC
12
18
17
9
15
13
5
23
AIC
29
3
AIC
21
2
1

METHOD AND APPARATUS FOR PRODUCING NITROGEN BY CRYOGENIC DISTILLATION OF AIR

This application claims priority to French Patent Application FR 1053075 filed Apr. 22, 2010, incorporated herein in its entirety.

BACKGROUND

The present invention relates to a method and an apparatus for producing nitrogen by cryogenic distillation. The pharmaceuticals industry is a potential market for the sale of nitrogen.

RELATED ART

In order to be fit for such an application, however, the nitrogen must satisfy the following specifications:

$CO_2$<300 ppm

CO<5 ppm $O_2$<5 ppm $H_2O$<67 ppm $N_2$>99.5%

All the purities in this document are molar purities.

Only the CO content may raise concern. This is because in a single-column nitrogen generator, with addition of liquid nitrogen in order to maintain refrigeration, the CO content in the nitrogen produced is about 80% of the CO content in the air supplying the single column.

It can therefore be seen that the critical CO content in the air, beyond which the constraint for the CO content in the nitrogen is no longer satisfied, is of the order of 6 ppm.

Although the normal content of CO in the air (0.6 ppm) is generally much less than this critical value, it is possible that it may significantly exceed the limit value, either continuously or more generally as a peak.

It will then be necessary to shut down the production by cryogenic distillation of air and supply the customer by vaporizing liquid nitrogen from a storage unit whose content has been controlled.

This is more expensive, and this operating mode has no autonomy other than the stored capacity of liquid.

It is known to reduce the carbon monoxide content of a nitrogen-rich product when the air has a constant carbon monoxide content. In this case, cryogenic distillation (EP-A-0376465, Gas Aktuell 39, 1990, pp 4-8) or catalysis (U.S. Pat. No. 5,441,719) may be used in order to purify the air or the nitrogen.

U.S. Pat. No. 4,617,040 and JP-A-05001882 describe a method according to the preamble of claim 1.

SUMMARY OF THE INVENTION

It is an object of the invention to permit the production of nitrogen with a very low carbon monoxide content by cryogenic distillation of air, even if the air supplying the column is occasionally highly polluted with carbon monoxide.

One aspect of the invention provides a method for producing nitrogen by cryogenic distillation of air, in which air containing carbon monoxide is sent to a cryogenic distillation column, a flow D of nitrogen is taken from the top of the distillation column, with a CO content less than a fixed value S1, and a flow of nitrogen-rich cryogenic liquid coming from an external source is sent to the top of the column, the flow rate of cryogenic liquid sent to the column being less than a value V if the CO content in the air does not exceed a previously defined threshold (S0), characterized in that: the flow rate of cryogenic liquid sent to the column is greater than a value V if the carbon monoxide content of the air exceeds this previously defined threshold (S0).

According to other optional aspects:

- the flow rate of air sent to the distillation column is reduced if the carbon monoxide content of the air exceeds the previously defined threshold;
- if the carbon monoxide content of the air is below the given threshold, the molar flow rate of cryogenic liquid sent to the column is at most equal to 5% of the molar flow rate of nitrogen gas D taken from the column;
- a flow of oxygen-enriched purging liquid is produced, characterized in that the flow rate of oxygen-rich cryogenic liquid produced is substantially constant when the flow rate of cryogenic liquid sent to the column is less than a value V and increased relative to the constant flow rate if the flow rate of cryogenic liquid sent to the column is greater than a value V;
- the increase in the oxygen-enriched molar flow rate taken off is substantially equal to the increase in the molar flow rate of cryogenic liquid sent to the column;
- the ratio between the flow rate of cryogenic liquid sent to the column and the carbon monoxide content of the air is constant;
- the flow rate of cryogenic liquid sent to the column has one or more given values if the carbon monoxide content of the air lies in one or more predefined ranges;
- the flow rate of cryogenic liquid is regulated according to the carbon monoxide content of the air;
- the flow rate of cryogenic liquid is regulated according to the carbon monoxide content of the nitrogen produced.

One aspect of the invention provides an apparatus for producing nitrogen by cryogenic distillation, comprising a cryogenic distillation column, a conduit for sending air containing carbon monoxide to the column, a conduit for taking a nitrogen-rich product from the column and a conduit for sending liquid nitrogen to the column from an external source, for example a storage unit, characterized in that it comprises means for regulating the flow rate of liquid nitrogen sent to the column as a function of the carbon monoxide content of the air.

The apparatus optionally comprises means for measuring the carbon monoxide content of the air or of the nitrogen-rich product and means for increasing the flow rate of liquid nitrogen sent to the column if the content exceeds a threshold.

The proposed invention makes it possible to increase significantly the limiting CO content in the air, beyond which sufficiently pure nitrogen gas can no longer be produced using the air separation apparatus.

BRIEF DESCRIPTION OF THE FIGURE

The invention will be described in more detail with reference to the FIGURE, which represents an air separation apparatus according to the invention.

DETAILED DESCRIPTION OF THE INVENTION

A flow of air 1, purified with respect to $CO_2$ and humidity but containing carbon monoxide, is cooled in a heat exchanger 2. Its carbon monoxide content is measured by an analyzer 3 upstream of the distillation column 5.

The air is separated into a nitrogen-rich top gas and an oxygen-enriched bottom liquid. The bottom liquid 17 is expanded through a valve 18 and sent to the top condenser 9 in a known way. The vaporized liquid 21 is heated in the exchanger 2. A nitrogen-rich gas product 29 is taken from the top of the column, heated in the exchanger 2 and sent to a customer. Its carbon monoxide content is measured by an analyzer 23 and must not exceed a threshold S1, for example 5 ppm.

Refrigeration of the apparatus is maintained by sending liquid nitrogen coming from a storage unit 7, which constitutes a source external to the air separation apparatus. The flow rate V of this liquid is substantially constant so long as the carbon monoxide content of the air does not exceed a threshold S0. The liquid nitrogen conduit 19 is connected to the top of the column 5 through a valve 11. A nitrogen-rich liquid can be taken from the column 5 through a conduit 13.

If the air 1 has a carbon monoxide content less than the given threshold S0, for example 5.9 ppm, the molar quantity V of liquid nitrogen sent to the column 5 through the conduit 19 corresponds to at most about 5% of the molar flow rate of nitrogen produced, optionally at most 3% of the molar flow rate of nitrogen produced, that is to say the quantity which is necessary in order to maintain refrigeration of the apparatus in the absence of an expansion turbine or other means for refrigeration. The quantity V is therefore substantially constant. The CO content of this nitrogen flow rate V is less than 5 ppm, since the liquid stored in this external storage unit 7 can if necessary serve as a backup after vaporization in the event of a shutdown, untimely or not, of the nitrogen production unit. All the liquid taken from the bottom is sent through the conduit 17 to the condenser 9.

If the carbon monoxide content exceeds the given threshold of S0 for the air, the analyzer 3 sends a signal to the FIC 12 in order to modify the flow rate sent through the conduit 19 in order to increase the quantity of liquid nitrogen arriving in the column, so that the flow rate exceeds the value V. The more impure the air is, the greater the increase must be. Owing to this method, by sending 10% of the nitrogen production flow rate as a liquid nitrogen flow, the limiting content of CO in the air can increase to 6.5 ppm without the carbon monoxide content of the nitrogen 19 produced exceeding 5 ppm, which is required by the standards. By sending liquid nitrogen corresponding to 40% of the nitrogen production flow rate, the limiting content of CO in the air 1 is 9.5 ppm without the carbon monoxide content of the nitrogen 19 produced exceeding 5 ppm, which is required by the standards.

When increasing the flow rate of liquid nitrogen, it is necessary to reduce the flow rate of supply air and therefore reduce the quantity of CO introduced into the nitrogen production unit; this also reduces the electricity consumption of the apparatus.

At the same time, an additional flow of oxygen-enriched liquid 13 is taken from the bottom of the column 5 by means of a valve 15 and a conduit when the carbon monoxide content of the air exceeds the threshold S0 and when the liquid nitrogen arrives through the conduit 19. This purging flow rate is substantially the same, on a molar basis, as the extra flow rate sent into the column through the conduit 19, and is extracted from the production unit. It may optionally be stored in a dedicated reservoir, or discharged to the atmosphere after vaporization.

The ratio between the flow rate of cryogenic liquid sent to the column and the carbon monoxide content of the air may be constant. If not, the flow rate of cryogenic liquid sent to the column may be fixed at one or more given values, the value being a function of the fact that the carbon monoxide content of the air lies in one or more predetermined ranges. For instance, the flow rate may be 10% if the content is between 5 and 6.5 ppm, and 40% if the content is between 6.5 and 9.5 ppm.

What is claimed is:

1. A method for producing nitrogen by cryogenic distillation of air, the method comprising the steps of:

analyzing a carbon monoxide content of an air stream;

sending the air stream to a cryogenic distillation column;

taking a flow D of nitrogen from the top of the distillation column, the flow D of nitrogen having a CO content less than a fixed value S1; and sending a flow of nitrogen-rich cryogenic liquid coming from an external source to the top of the cryogenic distillation column, the flow rate of the nitrogen-rich cryogenic liquid sent to the cryogenic distillation column being less than a value V if the CO content in the air stream does not exceed a previously defined threshold, wherein the flow rate of the nitrogen-rich cryogenic liquid sent to the cryogenic distillation column is greater than a value V if the carbon monoxide content of the air stream exceeds this previously defined threshold.

2. The method of claim 1, wherein the flow rate of air stream sent to the distillation column is reduced if the carbon monoxide content of the air stream exceeds the previously defined threshold.

3. The method of claim 1, wherein if the carbon monoxide content of the air stream is below the given threshold, the molar flow rate of the nitrogen-rich cryogenic liquid sent to the cryogenic distillation column is at most equal to 5% of the molar flow rate of nitrogen gas D taken from the cryogenic distillation column.

4. The method of claim 1, wherein a flow of oxygen-enriched purging liquid is produced, characterized in that the molar flow rate of oxygen-rich purging liquid is substantially constant when the molar flow rate of the nitrogen-rich cryogenic liquid sent to the cryogenic distillation column is less than a value V and increased if the flow rate of the nitrogen-rich cryogenic liquid sent to the cryogenic distillation column is greater than a value V.

5. The method of claim 4, wherein the increase in the molar flow rate of the oxygen-rich purging liquid is substantially equal to the increase in the molar flow rate of the nitrogen-rich cryogenic liquid sent to the cryogenic distillation column.

6. The method of claim 1, wherein the ratio between the molar flow rate of the nitrogen-rich cryogenic liquid sent to the cryogenic distillation column and the carbon monoxide content of the air stream is constant.

7. The method of claim 1, wherein the molar flow rate of the nitrogen-rich cryogenic liquid sent to the cryogenic distillation column has one or more given values if the carbon monoxide content of the air stream lies in one or more predefined ranges.

8. The method of claim 1, wherein the molar flow rate of the nitrogen-rich cryogenic liquid is regulated according to the carbon monoxide content of the air stream.

9. The method of claim 1, wherein the molar flow rate of the nitrogen-rich cryogenic liquid is regulated according to the carbon monoxide content of the nitrogen produced.

10. An apparatus for producing nitrogen by cryogenic distillation, the apparatus comprising:

a) a cryogenic distillation column;

b) a conduit configured to send an air stream containing carbon monoxide to the column;

c) a conduit configured to withdraw a nitrogen-rich product from the column;

d) a conduit configured to send liquid nitrogen to the column from an external source;

e) a means for regulating the flow rate of liquid nitrogen sent to the cryogenic distillation column as a function of the carbon monoxide content of the air stream; and f) a means for increasing the flow rate of liquid nitrogen sent to the cryogenic distillation column if the carbon monoxide content of the air stream exceeds a threshold.

11. The apparatus of claim 10, wherein said external source is a storage unit.

12. The apparatus of claim 10, further comprising a means for measuring the carbon monoxide content of the air stream or of the nitrogen-rich product.

13. The method of claim 1, further comprising the step of sending at least a portion of the flow D of nitrogen to a customer for use as a pharmaceutical gas.

14. The method of claim 13, wherein the at least a portion of the flow D of nitrogen comprises:

$CO_2$ in an amount less than 300 ppm;

CO in an amount less than 5 ppm;

$O_2$ in an amount less than 5 ppm;

$H_2O$ in an amount less than 67 ppm; and $N_2$ in an amount greater than 99.5 mol %.

15. A method for producing nitrogen for use in the pharmaceutical industry using an apparatus comprising a heat exchanger configured to cool an air stream to a temperature effective for cryogenic rectification and a distillation column configured to received the air stream and separate the air stream into at least two separate streams, the method comprising the steps of:

analyzing the carbon monoxide content of the air stream upstream of the distillation column using a first analyzer, wherein the air stream has been previously pressurized and cooled to a pressure and temperature suitable for cryogenic rectification, wherein the air stream is substantially free of carbon dioxide and water such that the air stream is suitable for cryogenic rectification within the distillation column;

introducing the air stream to the distillation column under conditions effective for the separation of oxygen and nitrogen within the distillation column to produce a nitrogen-rich top gas and an oxygen-enriched bottom liquid;

withdrawing a flow D of the nitrogen-rich top gas from the top of the distillation column, heating the flow D in a heat exchanger, and then sending at least a portion of the flow D as a nitrogen product to a customer for use in the pharmaceutical industry, wherein the nitrogen product comprises $CO_2$ in an amount less than 300 ppm, CO in an amount less than 5 ppm, $O_2$ in an amount less than 5 ppm, $H_2O$ in an amount less than 67 ppm, and $N_2$ in an amount greater than 99.5 mol %;

analyzing the carbon monoxide content of flow D prior to heating in the heat exchanger using a second analyzer; and sending a flow of nitrogen-rich cryogenic liquid coming from an external source to the distillation column, wherein the flow of nitrogen-rich cryogenic liquid is in an amount V, wherein if the carbon monoxide content of the air stream exceeds a previously defined threshold (S0), the flow of nitrogen-rich cryogenic liquid is increased to an amount greater than the amount V while also reducing the flow rate of the air stream introduced to the distillation column, such that the carbon monoxide content of flow D does not rise above a fixed value S1.

16. The method of claim 15, wherein the fixed value S1 is 5 ppm.

17. The method of claim 15, wherein the amount V is an amount that is, at a minimum, effective to provide refrigeration to the apparatus in the absence of an expansion turbine or other means for refrigeration.

18. The method of claim 15, wherein the apparatus further comprises a controller that is in communication with the first analyzer and the second analyzer, wherein the controller is configured to effectuate an increase or decrease in the flow of nitrogen-rich cryogenic liquid coming from the external source to the distillation column based upon the carbon monoxide content of the air stream upstream of the distillation column.

19. The method of claim 15, wherein a flow of oxygen-enriched purging liquid is produced, characterized in that the molar flow rate of the oxygen-rich purging liquid is substantially constant when the molar flow rate of the nitrogen-rich cryogenic liquid sent to the distillation column is less than the amount V and increased if the flow rate of the nitrogen-rich cryogenic liquid sent to the cryogenic distillation column is greater than the amount V.

20. The method of claim 15, wherein the ratio between the flow rate of the nitrogen-rich cryogenic liquid sent to the distillation column and the carbon monoxide content of the air stream is constant.

21. The method of claim 15, wherein the flow rate of the nitrogen-rich cryogenic liquid sent to the distillation column has one or more given values if the carbon monoxide content of the air stream lies in one or more predefined ranges.

* * * * *